US008839771B2

(12) United States Patent
Tseng

(10) Patent No.: US 8,839,771 B2
(45) Date of Patent: Sep. 23, 2014

(54) SAFETY FOR A TRIGGER MECHANISM OF AN AIR GUN

(76) Inventor: Shu-Mei Tseng, New Taipei (TW)

( * ) Notice: Subject to any disclaimer, the term of this patent is extended or adjusted under 35 U.S.C. 154(b) by 134 days.

(21) Appl. No.: 13/598,781

(22) Filed: Aug. 30, 2012

(65) Prior Publication Data

US 2014/0060509 A1 Mar. 6, 2014

(51) Int. Cl.
*F41B 11/00* (2013.01)

(52) U.S. Cl.
USPC ..... 124/40; 124/73

(58) Field of Classification Search
USPC ..... 124/40, 73, 74, 76
See application file for complete search history.

(56) References Cited

U.S. PATENT DOCUMENTS

| | | | | | |
|---|---|---|---|---|---|
| 4,173,964 | A * | 11/1979 | Curran | ..... | 124/40 |
| 4,649,893 | A * | 3/1987 | Heitz | ..... | 124/37 |
| 5,906,191 | A * | 5/1999 | Wonisch et al. | ..... | 124/31 |
| 6,612,298 | B2 * | 9/2003 | Mendoza-Orozco | ..... | 124/37 |

* cited by examiner

*Primary Examiner* — John Ricci

(57) ABSTRACT

An air gun includes a gun body; a stock extending rearward from the gun body; a trigger extending downward from the gun body; a gas cartridge containing pressurized gas disposed in the stock; a magazine releasably secured to the gun body; an actuator including a spring biased sliding bar including an external handle, a protrusion projecting downward from the sliding bar, a spring biased sliding rod disposed under the sliding bar, and a sliding block engaging the sliding rod and including a protuberance facing the gas cartridge; and a safety mechanism disposed adjacent to a trigger and including a safety lever, a cam disposed at one end of the safety lever and being co-rotatable with the safety lever, the cam having an annular shoulder, a spring biased rod aligned with the safety lever and spaced from the cam in an inoperative position.

4 Claims, 14 Drawing Sheets

SAFETY FOR A TRIGGER MECHANISM OF AN AIR GUN

BACKGROUND OF THE INVENTION

1. Field of the Invention

The invention relates to air guns and more particularly to a safety for a trigger mechanism of an air gun.

2. Description of Related Art

A conventional trigger mechanism of an air gun comprises a cocking module for movable between a rest position and a cocking position for cocking a spring biased piston; a trigger mechanism for retaining and releasing the cocked piston, the trigger mechanism including a retaining member connected to the piston, a trigger lever adapted to engage the retaining member when the piston is cocked, the trigger lever having a portion overlapping the retaining member when in engagement therewith, and a trigger coupled to the trigger lever for moving the trigger lever out of engagement with the retaining member; and an intermediate module including intermediate members operatively coupling the cocking module and the trigger lever for reducing the overlap of the trigger lever over the retaining member after cocking during the last part of travel of the cocking module back to the rest position.

However, its safety is not reliable due to complicated components and malfunction is often. Thus, the need for improvement still exists.

SUMMARY OF THE INVENTION

It is therefore one object of the invention to provide a air gun comprising a gun body; a stock extending rearward from the gun body; a trigger extending downward from the gun body; a gas cartridge containing pressurized gas disposed in the stock; a magazine releasably secured to the gun body; an actuator comprising a spring biased sliding bar including an external handle, a protrusion projecting downward from the sliding bar, a spring biased sliding rod disposed under the sliding bar, and a sliding block engaging the sliding rod and including a protuberance facing the gas cartridge; and a safety mechanism disposed adjacent to a trigger and comprising a safety lever, a cam disposed at one end of the safety lever and being co-rotatable with the safety lever, the cam having an annular shoulder, a spring biased rod aligned with the safety lever and spaced from the cam in an inoperative position; wherein in response to pivoting the safety lever, the cam pushes a portion of the spring biased rod a cavity adjacent to the trigger; and wherein a pulling of the trigger lift a projection above the spring biased rod; and wherein a pulling of the handle moves the sliding rod which in turn moves the sliding block to insert the protuberance into the gas cartridge to release the pressurized gas out of the gas cartridge.

The above and other objects, features and advantages of the invention will become apparent from the following detailed description taken with the accompanying drawings.

DETAILED DESCRIPTION OF THE INVENTION

Figure 1:
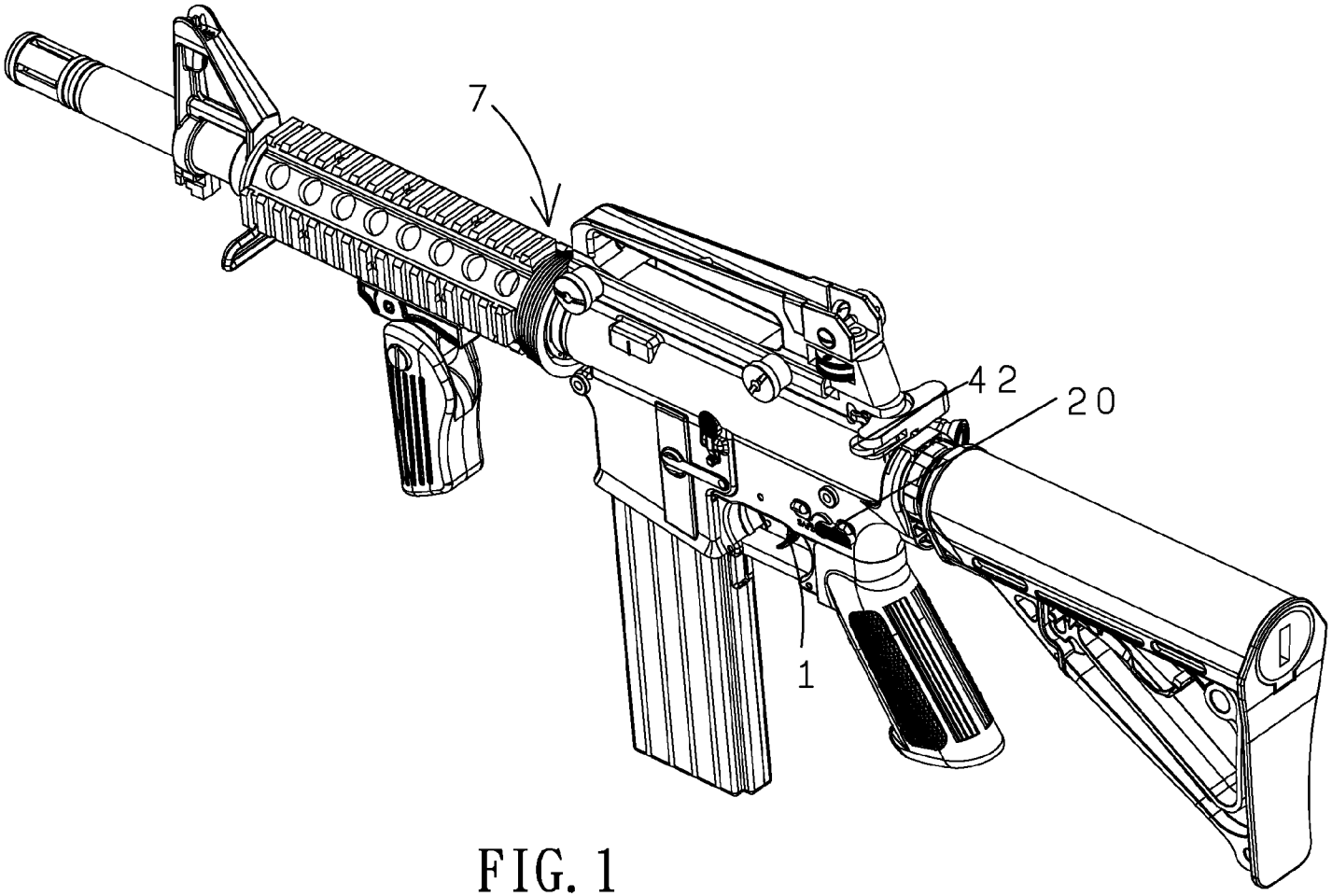
FIG. 1 is a perspective view of an air gun incorporating a safety for a trigger mechanism according to the invention.
Figure 2:
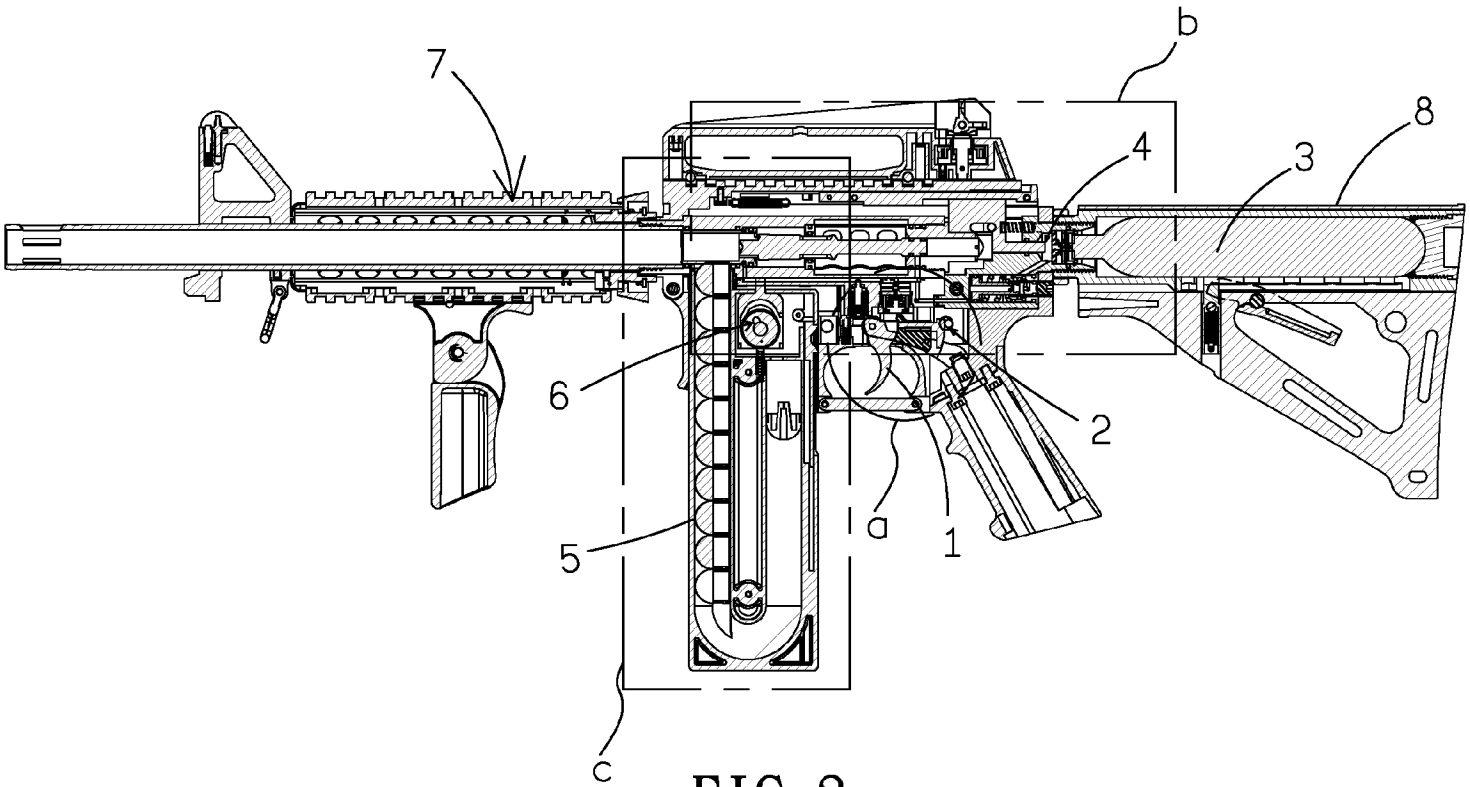
FIG. 2 is a longitudinal sectional view of the air gun.
Figure 3A:
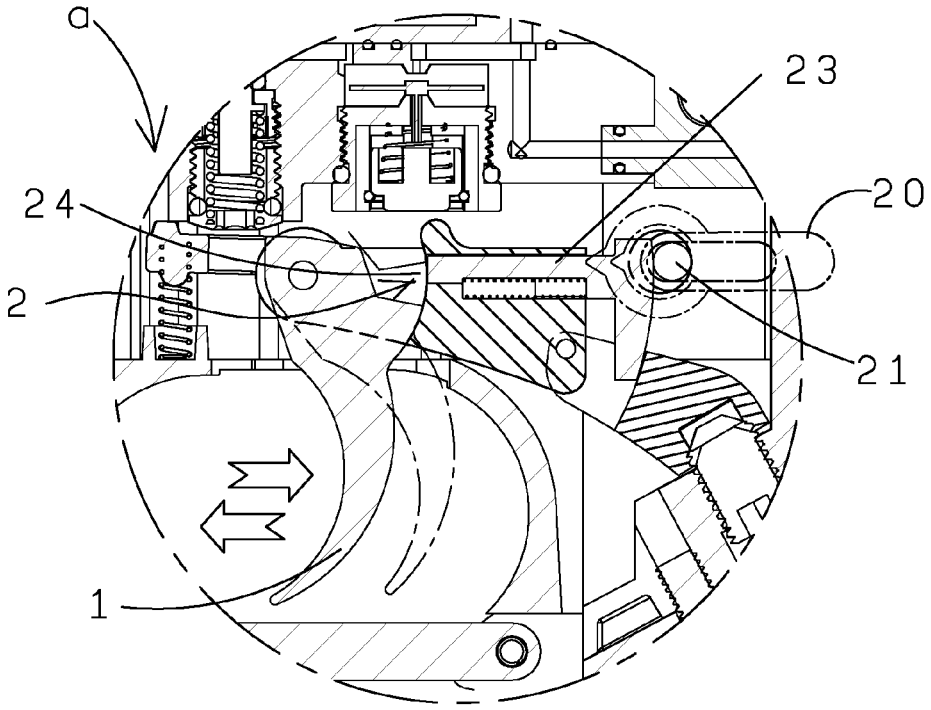
FIG. 3A is a detailed view of a circle a in FIG. 2.
Figure 3B:
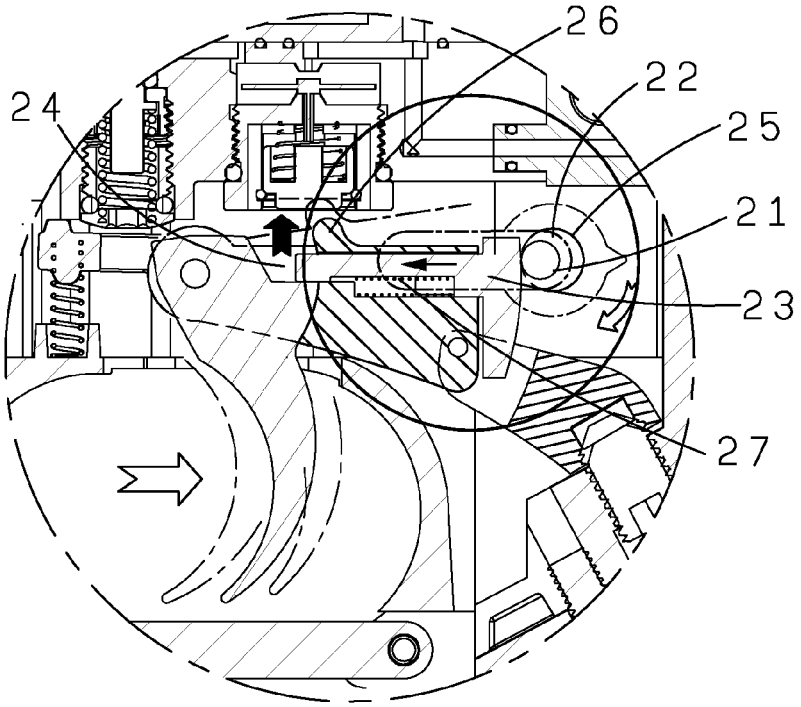
FIG. 3B is a view similar to FIG. 3A showing a trigger being pulled for firing.
Figure 4A:
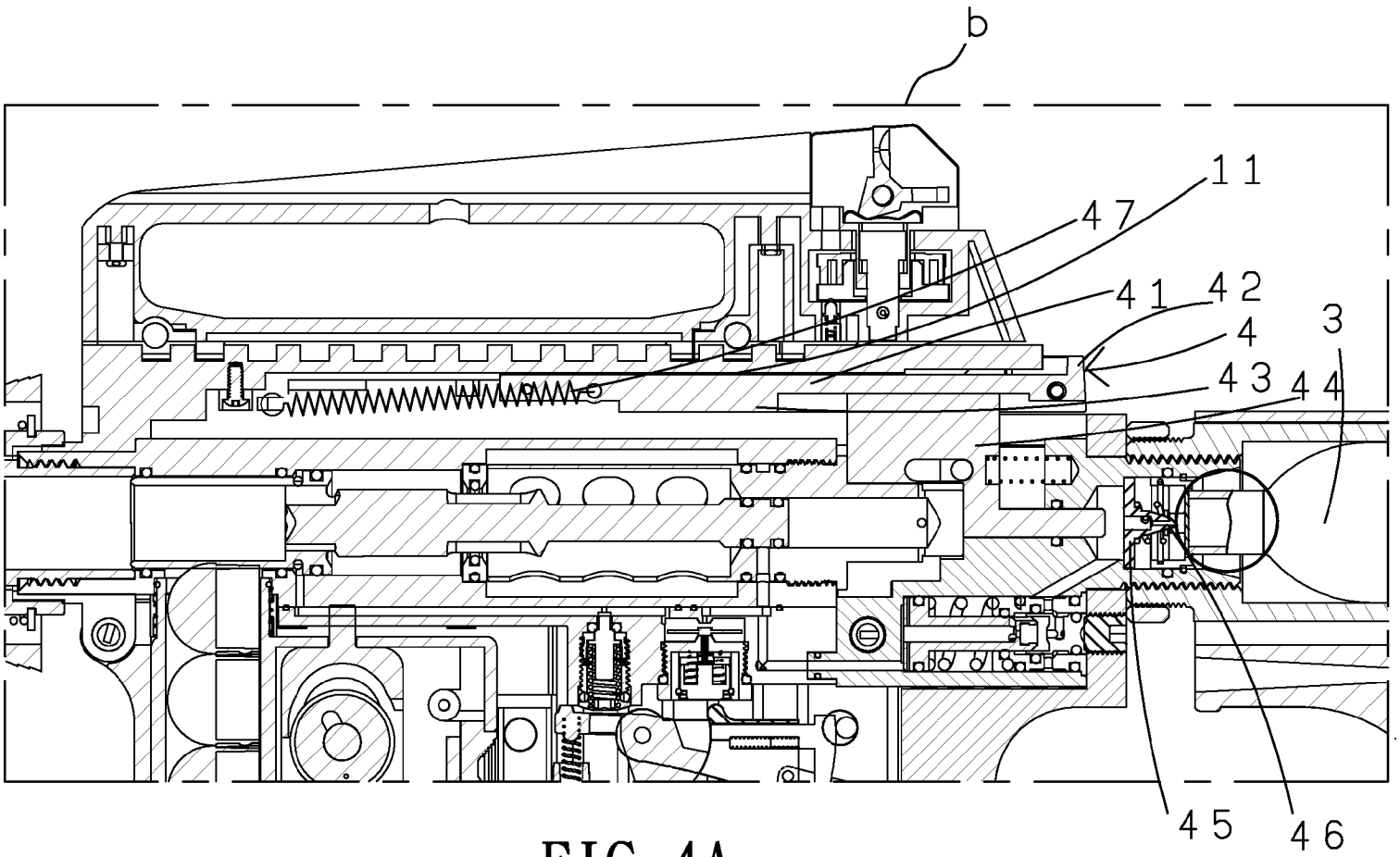
FIG. 4A is a detailed view of a circle b in FIG. 2.
Figure 4B:
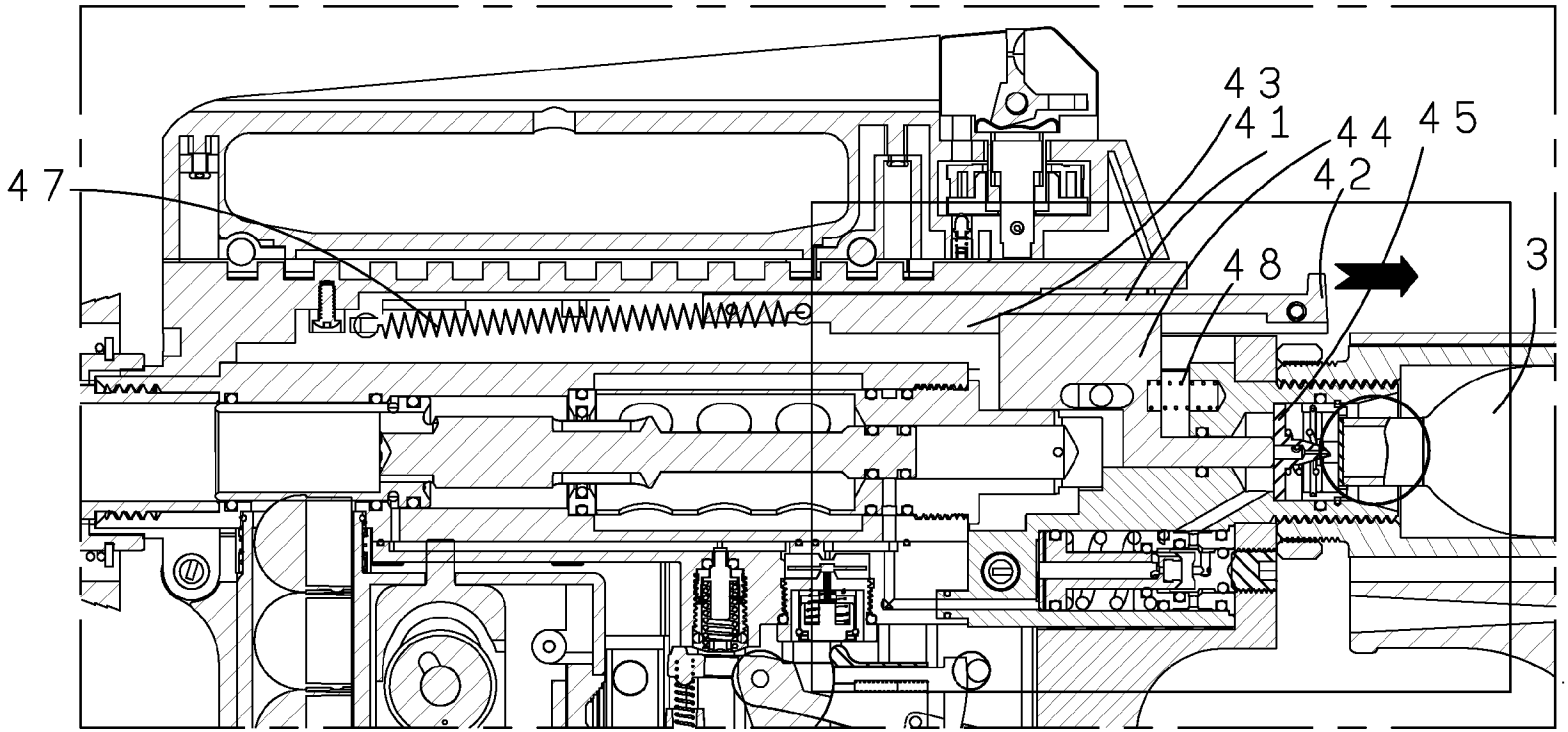
FIG. 4B is a view similar to FIG. 4A showing a handle member being pulled.
Figure 4C:
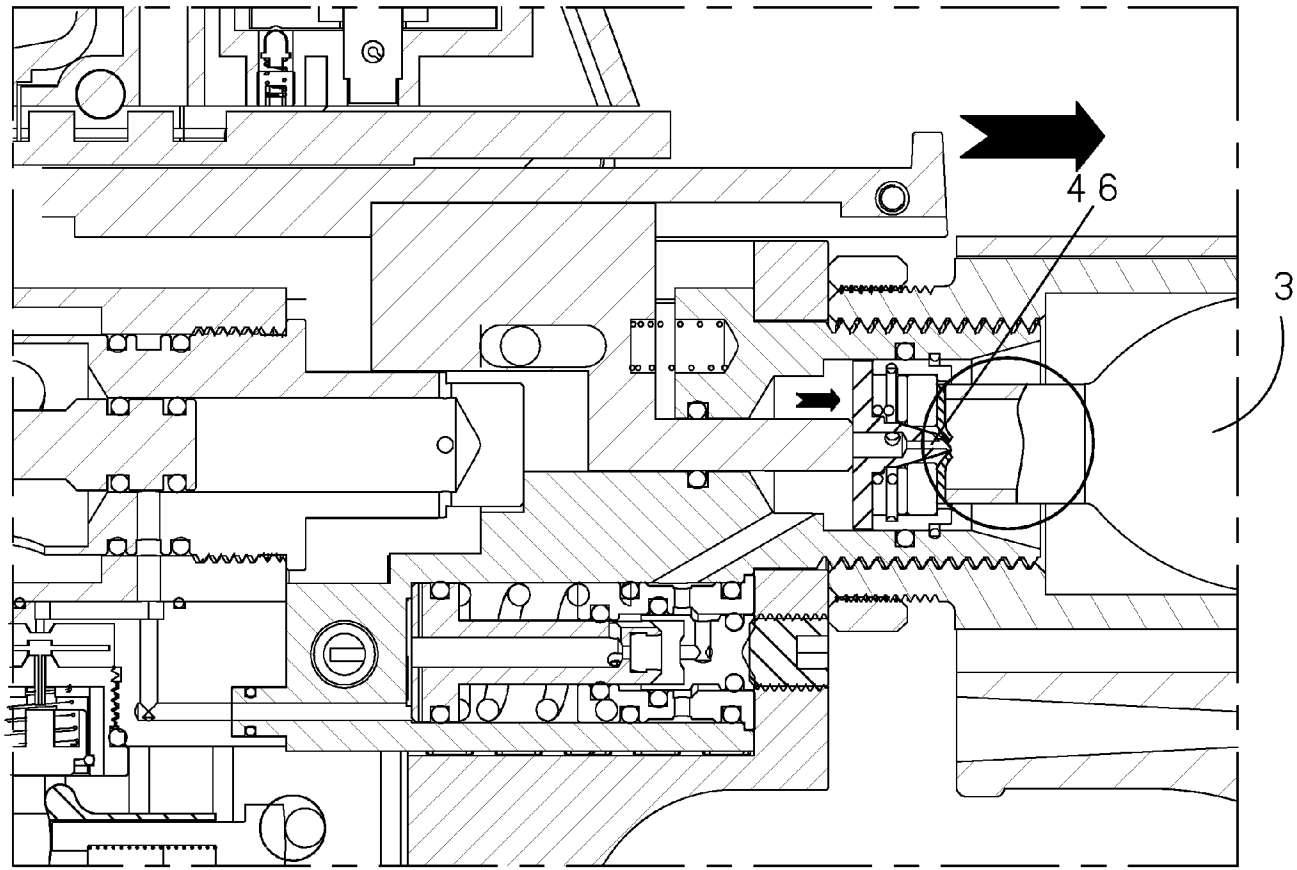
FIG. 4C is a view similar to FIG. 4B showing a gas cartridge being opened as a result of pulling the handle member.
Figure 5:
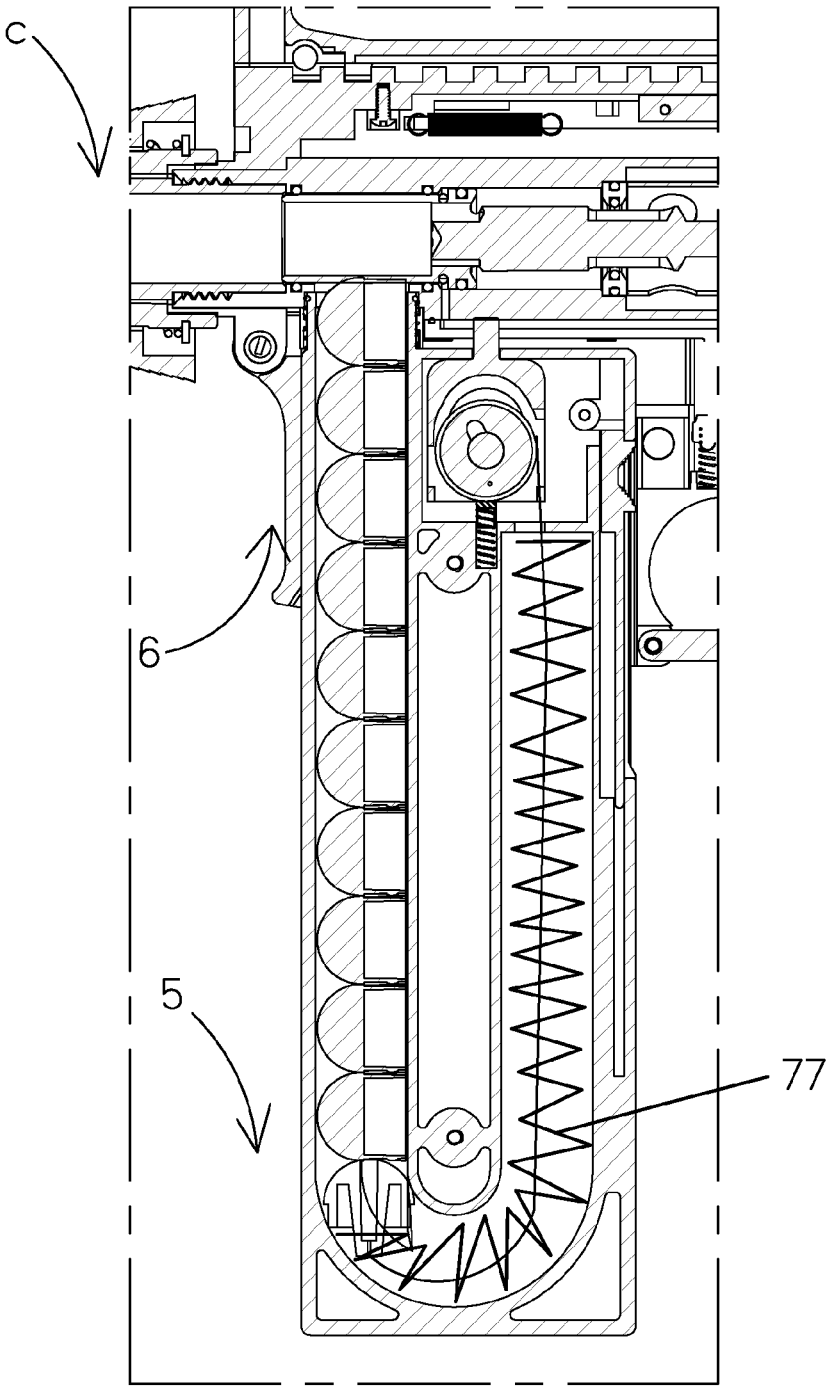
FIG. 5 is a detailed view of a circle c in FIG. 2.
Figure 6A:
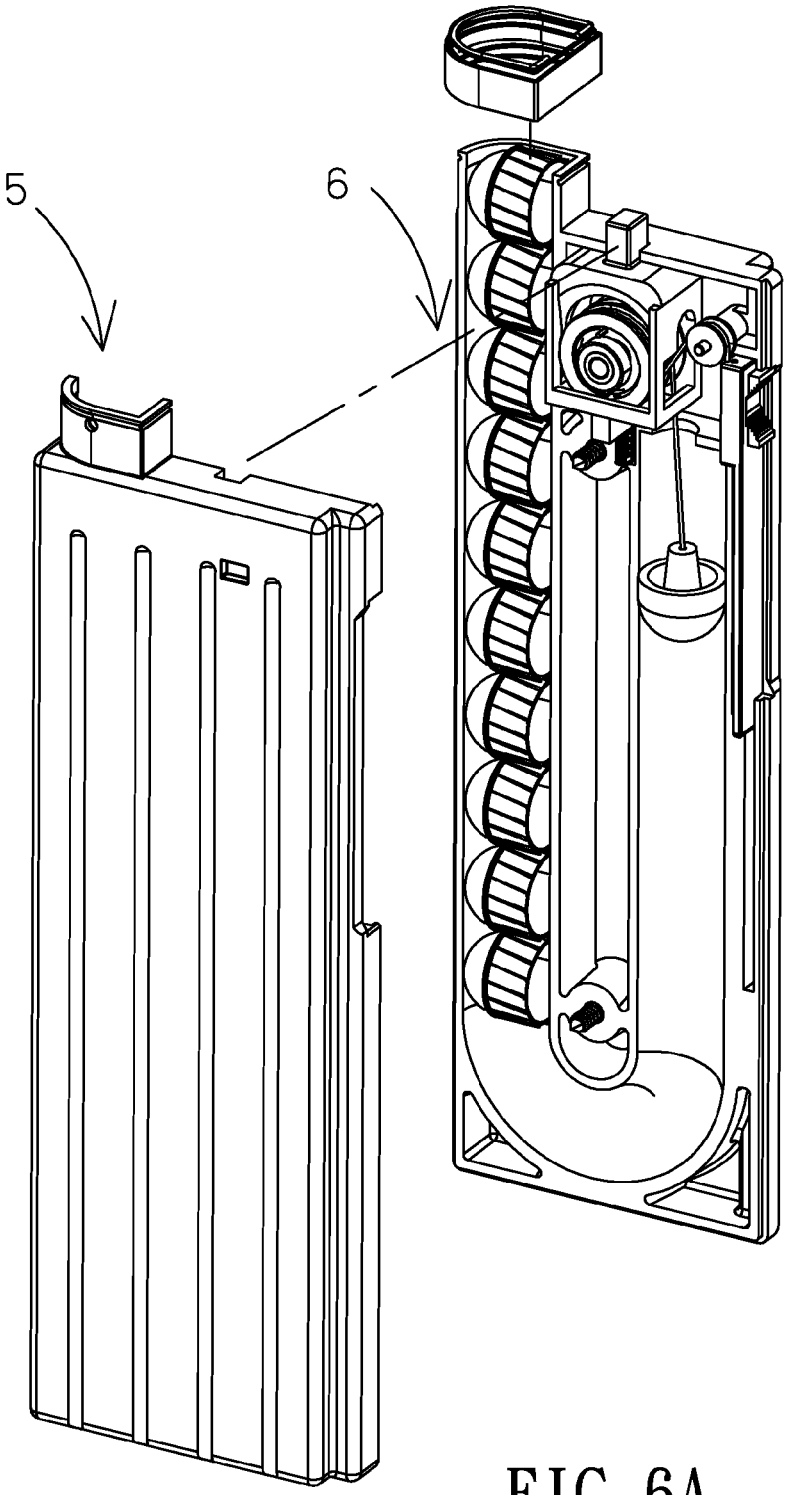
FIG. 6A is an exploded view of a magazine loaded with projectiles.
Figures 6B, 6C, 6D:
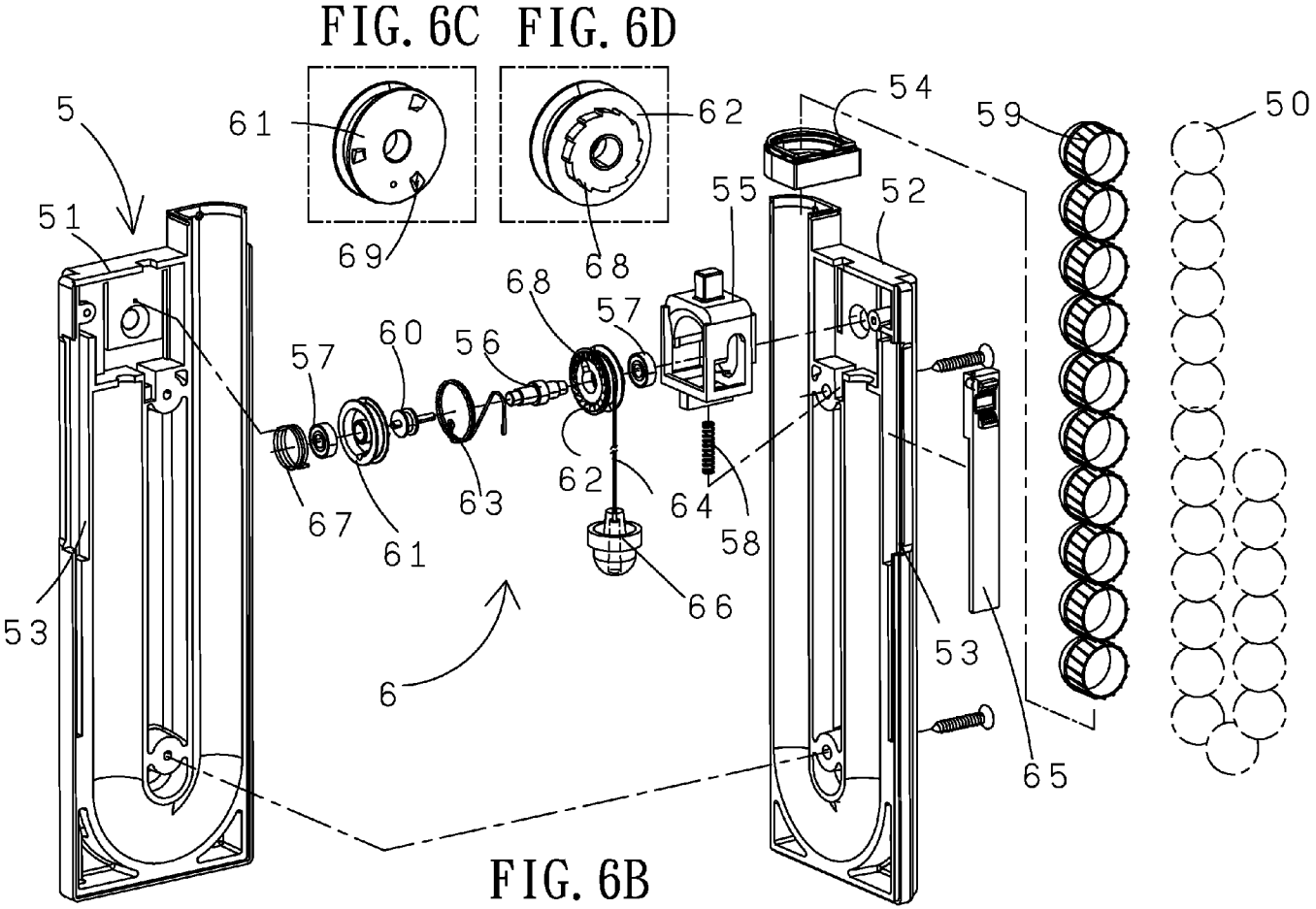
FIG. 6B is a further exploded view of the magazine of FIG. 6A.
FIG. 6C a perspective view of the first wheel showing its surface other than that shown in FIG. 6B.
FIG. 6D a perspective view of the second wheel showing its surface other than that shown in FIG. 6B.
Figure 7:
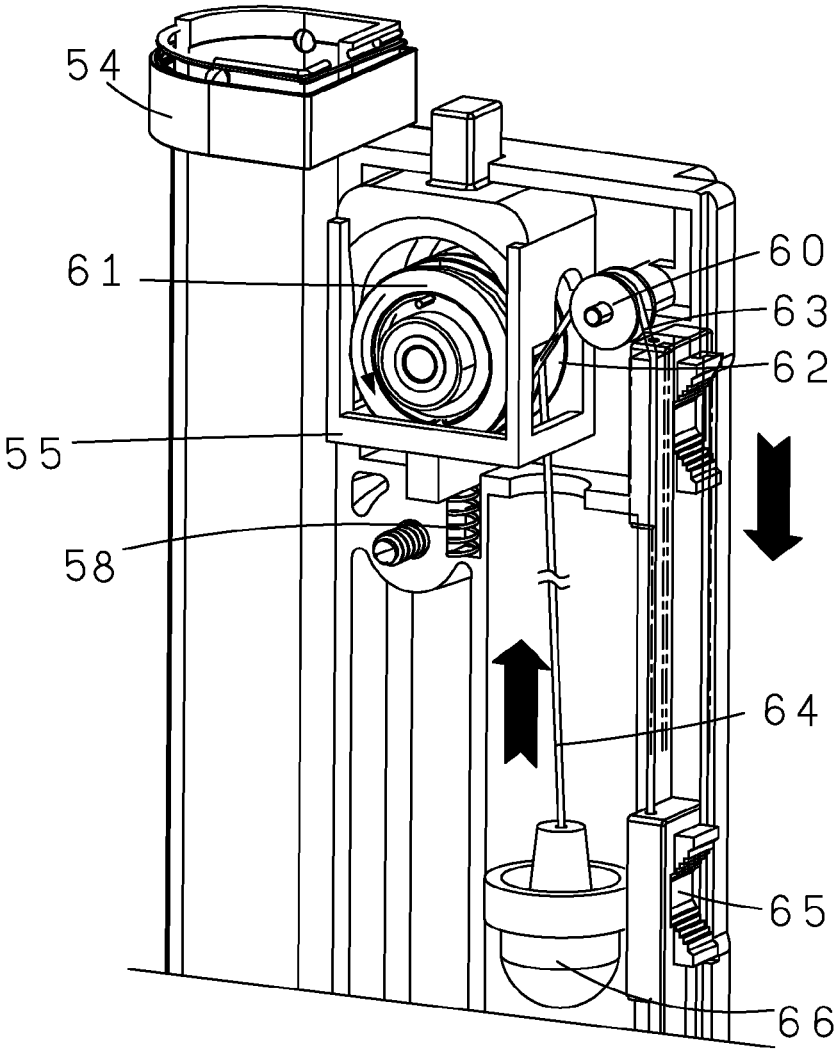
FIG. 7 is a broken away perspective view of an upper portion of the magazine.
Figure 8A:
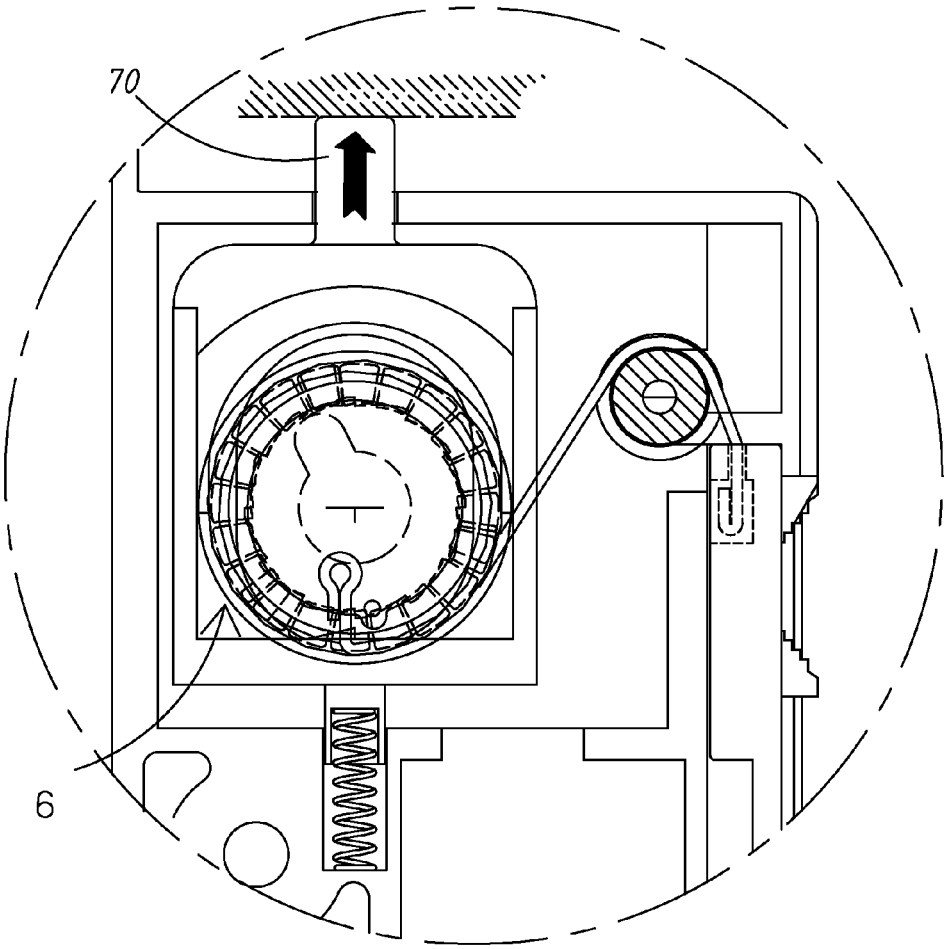
FIG. 8A is a front view of an upper portion of FIG. 7.
Figure 8B:
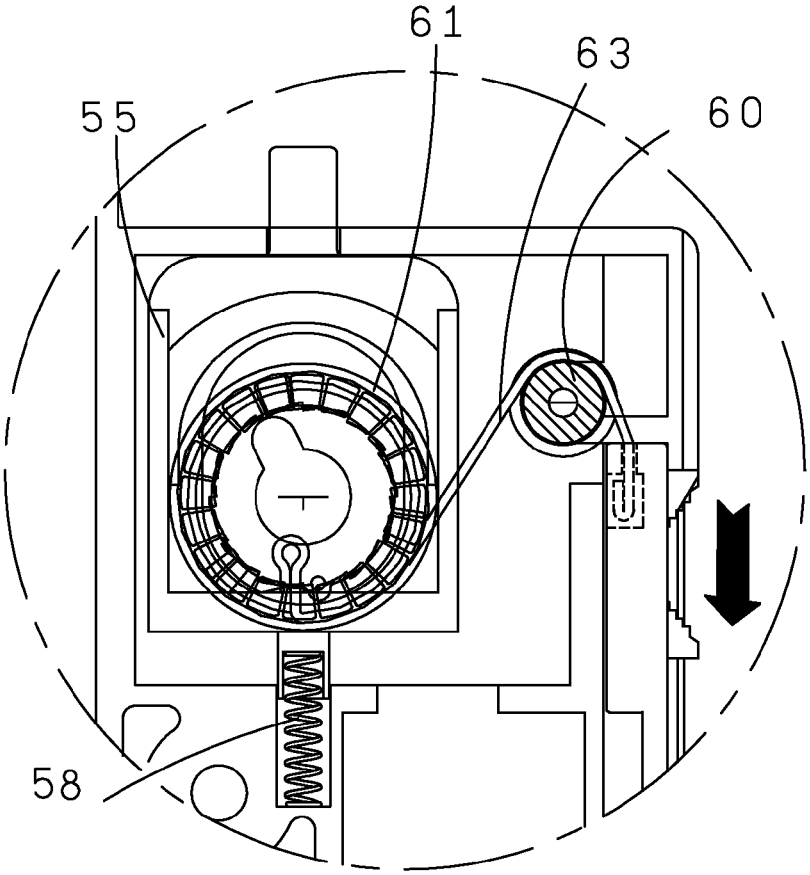
FIG. 8B is a view similar to FIG. 8A showing the projectile loading mechanism being pushed upward.
Figure 9A:
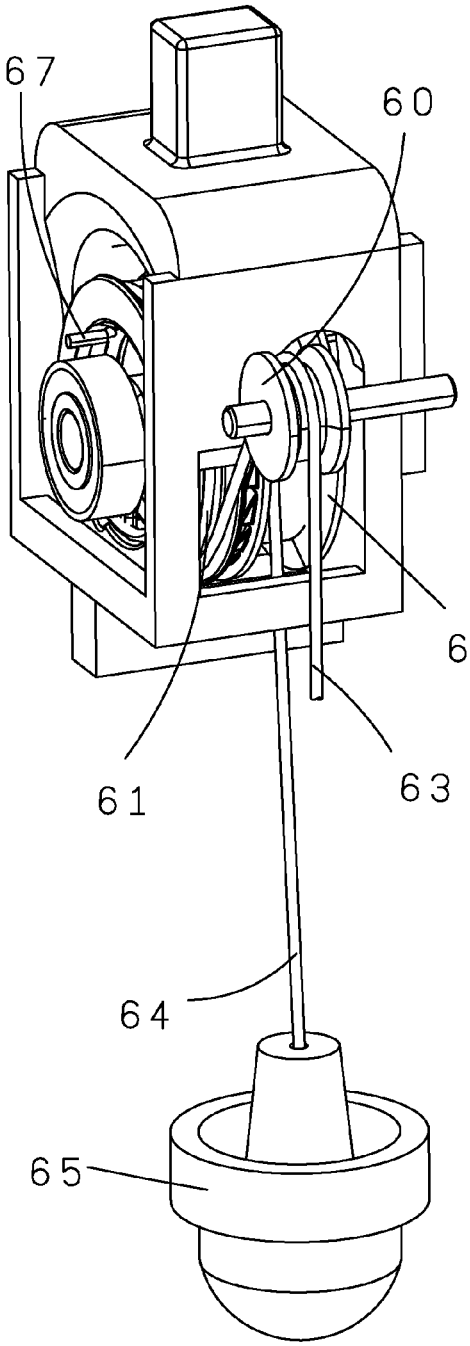
FIGS. 9A and 9B are two different perspective views of the projectile loading mechanism respectively.
Figure 9B:
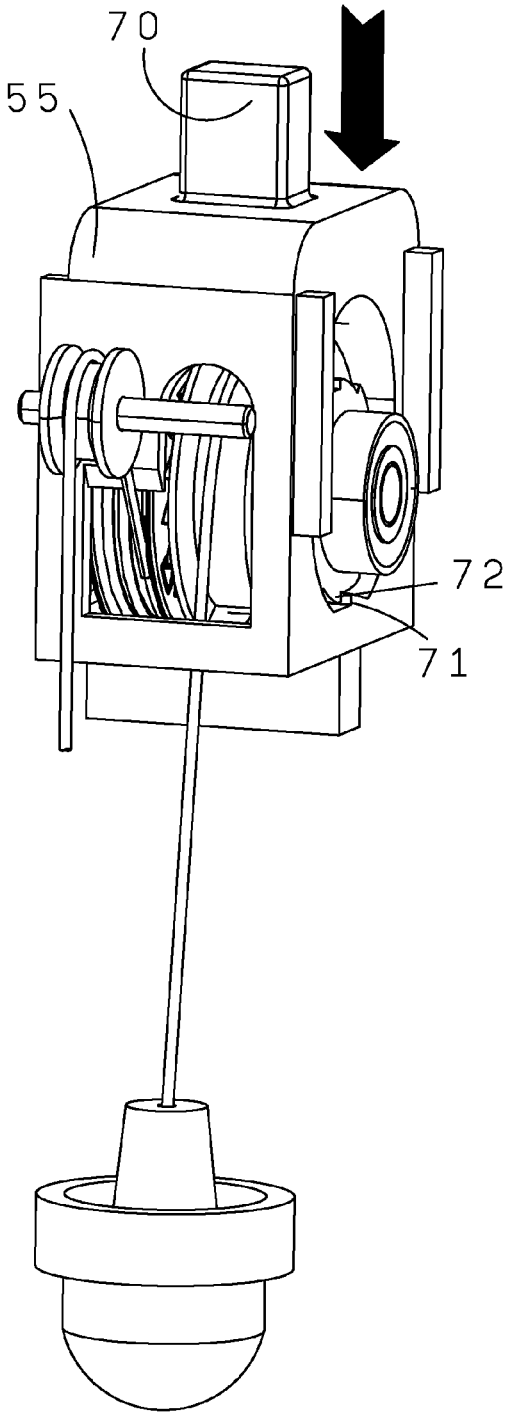
Figure 10:
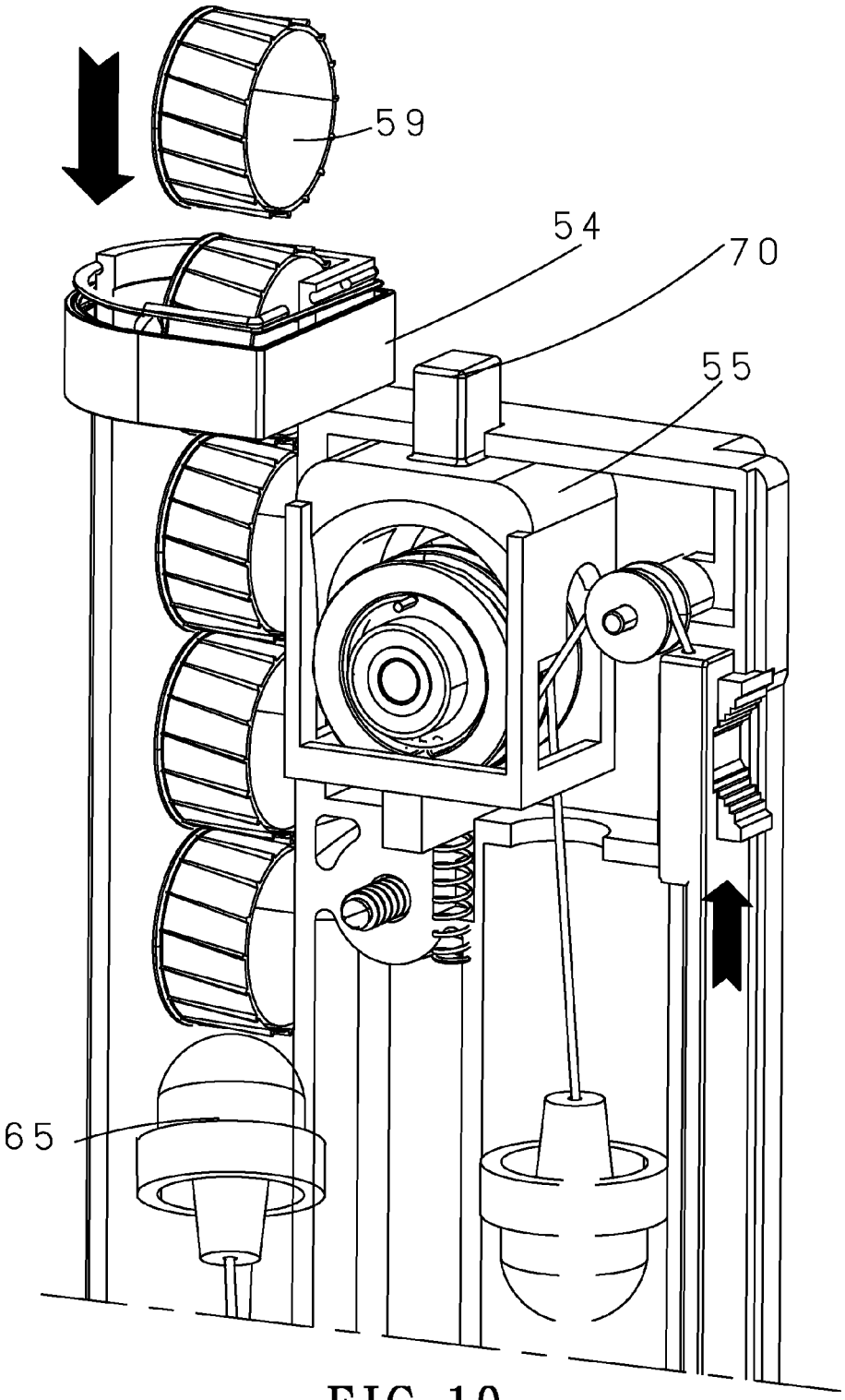
FIG. 10 is a view similar to FIG. 7 showing the magazine loaded with projectiles.

Referring to FIGS. 1 to 10, an air gun in accordance with the invention comprises the following components as discussed in detail below.

A gun body 7 is provided. A safety mechanism 2 is provided adjacent to a trigger 1. A gas cartridge 3 is provided in a stock 8. An actuator 4 is provided on a mouth of the gas cartridge 3. A projectile loading mechanism 6 is provided at a joining portion of a magazine 5 and the gun body 7. The safety mechanism 2 comprises a safety lever 20 disposed on a surface of the gun body 7, a cam 21 provided at one end of the safety lever 20, an axle 25 being coaxial with both one end of the safety lever 20 and the cam 21, and the cam 21 having an annular shoulder 22 which is spaced from a rod 23 when the cam 21 does not rotate. The cam 21 can be actuated by pivoting the safety lever 20 and further the actuator 4 is required to actuate to allow pressurized gas in the gas cartridge 3 to release for firing. For example, the cam 21 pushes the rod 23 to cause a forward end of the rod 23 insert into a cavity 24 adjacent to a pivot of the trigger 1 when the safety lever 20 turns an angle of about 90-degree to 180-degree. The trigger 1 is thus in firing position. A person may pull the trigger 1 rearward to move a projection 26 above the rod 23 upward for firing with a torsion spring 27 engaging the rod 23 being compressed.

The actuator 4 comprises a sliding bar 41 disposed in an elongated channel 11 in the gun body 7 and having one end formed with an external handle 42, and a spring member 47 having one end secured to the other end of the sliding bar 41 (i.e., the sliding bar 41 being a spring biased member) and the other end fastened at a blind end of the channel 11. A protrusion 43 projects downward from the sliding bar 41. The protrusion 43 may move rearward to also move a sliding rod 44 rearward by pulling the sliding bar 41. The sliding rod 44 is a spring biased member due to the provision of a spring element 48 connected thereto. And in turn, a sliding block 45 engaging the sliding rod 44 moves rearward. The rearward movement of the sliding block 45 pulls a protuberance 46, formed with the sliding block 45, rearward. As a result, the protuberance 46 inserts into the mouth of the gas cartridge 30 to release the pressurized gas (i.e., firing). After firing, the torsion spring 27 is expanded to return the rod 23 to its inoperative position. Further, the energized spring member 47 pulls back the sliding bar 41 to its inoperative position and the energized spring element 48 also pulls back the sliding rod 44 to its inoperative position. It is noted that the firing is carried out only after pivoting the safety lever 20 to its unlocked (i.e., cocking) position.

The projectile loading mechanism 6 is disposed in the magazine 5 and comprises a first wheel 61, a second wheel 62, and a first rope 63 running along a circumference of the first wheel 61 and an adjacent idler wheel 60 to be secured to a tab 65 which is disposed on a trough 53 on an outer surface of the magazine 5. The magazine 5 comprises a first half 51 and a complementary second half 52. A person may press a projecting magazine catch 70 to move a housing 55 downward. The housing 55 in turn compresses a spring 58 so that a pawl 71 disengages from a ratchet 72. As a result, the magazine 7 is detached from the gun body 7.

A person may slide the tab 65 downward to pull the first rope 63 so as to turn the first wheel 61. An axle 56 is provided through both the first and second wheels 61, 62. Two bearings 57 are provided on both ends of the axle 56 and disposed adjacent to centers of the first and second wheels 61, 62 respectively. A torsion spring 67 has one end fastened in the first half 51 and the other end fastened in the first wheel 61. As such, the first wheel 61 is a spring actuated member. On one surface (e.g., inner surface) of the second wheel 62 there are provided a gear (i.e., ratchet gear) 68 and on an edge of one surface (e.g., inner surface) of the first wheel 61 there are provided three equally spaced pawls 69 adapted to engage the gear 68. A second rope 64 runs along a circumference of the second wheel 62 and has a free end formed as a weight 66 so that a pulling of the second rope 64 downward can turn the second wheel 62 and lower the weight 66 and vice versa. Further, a locking member 54 on top of the magazine 5 is required to remove prior to loading projectiles. A capacity of the magazine 5 is 20 spherical plastic pellets 50 or 10 hollow, cylindrical plastic shells 59. Each downward pulling of the tab 65 can load four plastic pellets 50 or two plastic shells 59. A spring element 77 is provided in a channel of the magazine 5 and has a free end biased against the bottommost shell 59 which engages the weight 66.

While the invention has been described in terms of preferred embodiments, those skilled in the art will recognize that the invention can be practiced with modifications within the spirit and scope of the appended claims.

What is claimed is:

1. An air gun comprising:

a gun body;

a stock extending rearward from the gun body;

a trigger extending downward from the gun body;

a gas cartridge containing pressurized gas disposed in the stock;

a magazine releasably secured to the gun body;

an actuator comprising a spring biased sliding bar including an external handle, a protrusion projecting downward from the sliding bar, a spring biased sliding rod disposed under the sliding bar, and a sliding block engaging the sliding rod and including a protuberance facing the gas cartridge; and a safety mechanism disposed adjacent to a trigger and comprising a safety lever, a cam disposed at one end of the safety lever and being co-rotatable with the safety lever, the cam having an annular shoulder, a spring biased rod aligned with the safety lever and spaced from the cam in an inoperative position;

wherein in response to pivoting the safety lever, the cam pushes a portion of the spring biased rod into a cavity adjacent to the trigger;

wherein a pulling of the trigger lifts a projection above the spring biased rod; and wherein a pulling of the handle moves the sliding rod which in turn moves the sliding block to insert the protuberance into the gas cartridge to release the pressurized gas out of the gas cartridge.

2. The air gun of claim 1, further comprising a projectile loading mechanism disposed in the magazine and comprising a spring actuated first wheel including a plurality of pawls formed on an edge of one surface, a second wheel including a gear formed on one surface, the gear engaging the pawls, a second rope running along a circumference of the second wheel and having a free end formed as a weight, an idler wheel, a first rope running along a circumference of the first wheel and the idler wheel to be secured to a tab disposed on an outer surface of the magazine, and a spring biased housing including a magazine catch, a pawl member, and a ratchet member.

3. The air gun of claim 2, wherein a downward movement of the magazine catch moves the housing downward which in turn disengages the pawl from the ratchet to detach the magazine from the gun body.

4. The air gun of claim 2, wherein a downward movement of the tab pulls the first rope to turn the first wheel; and wherein a pulling of the second rope downward turns the second wheel and lowers the weight.

* * * * *